US007298351B2

(12) United States Patent
Kim

(10) Patent No.: US 7,298,351 B2
(45) Date of Patent: Nov. 20, 2007

(54) REMOVING CROSSTALK IN AN ORGANIC LIGHT-EMITTING DIODE DISPLAY

(75) Inventor: Chang Oon Kim, Yongin-si (KR)

(73) Assignee: Leadia Technology, Inc., Sunnyvale, CA (US)

( * ) Notice: Subject to any disclaimer, the term of this patent is extended or adjusted under 35 U.S.C. 154(b) by 622 days.

(21) Appl. No.: 10/884,721

(22) Filed: Jul. 1, 2004

(65) Prior Publication Data

US 2006/0001615 A1 Jan. 5, 2006

(51) Int. Cl.
*G09G 3/34* (2006.01)

(52) U.S. Cl. ..... 345/77; 345/82; 345/39

(58) Field of Classification Search ..... 345/36, 345/38–39, 42, 45–48, 55, 58, 63, 76–77, 345/80–82, 84, 87, 89, 90–93, 204–206
See application file for complete search history.

(56) References Cited

U.S. PATENT DOCUMENTS

| | | | |
|---|---|---|---|
| 3,674,928 | A | 7/1972 | Yoshiyama et al. |
| 5,170,158 | A | 12/1992 | Shinya |
| 5,420,604 | A | 5/1995 | Scheffer et al. |
| 5,572,211 | A | 11/1996 | Erhart et al. |
| 5,684,502 | A | 11/1997 | Fukui et al. |
| 5,689,280 | A | 11/1997 | Asari et al. |
| 5,747,363 | A | 5/1998 | Wei et al. |
| 5,754,157 | A | 5/1998 | Kuwata et al. |
| 5,764,212 | A | 6/1998 | Nishitani et al. |
| 5,786,799 | A | 7/1998 | Matsui et al. |
| 5,818,409 | A | 10/1998 | Furuhashi et al. |
| 5,852,429 | A | 12/1998 | Scheffer et al. |
| 5,877,738 | A | 3/1999 | Ito et al. |
| 5,900,856 | A | 5/1999 | Iino et al. |
| 6,040,815 | A | 3/2000 | Erhart et al. |
| 6,097,352 | A | 8/2000 | Zavracky et al. |
| 6,252,572 | B1 | 6/2001 | Kurumisawa et al. |
| 6,417,827 | B1 | 7/2002 | Nagao et al. |
| 6,483,497 | B1 | 11/2002 | Iino et al. |

(Continued)

FOREIGN PATENT DOCUMENTS

EP 0837446 A1 4/1998

(Continued)

OTHER PUBLICATIONS

International Search Report and Written Opinion of the International Searching Authority, for International Application No. PCT/US05/21587, May 4, 2006.

*Primary Examiner*—Alexander Eisen
*Assistant Examiner*—Jason M Mandeville
(74) *Attorney, Agent, or Firm*—Fenwick & West LLP

(57) ABSTRACT

A driver includes a plurality of variable resistors each coupled to a corresponding one of the rows of the organic light-emitting diode display panel, generally between Ground (GND) and the cathodes of the OLEDs on the rows. A variable resistor controller in the driver is coupled to the variable resistors, and adjusts the resistance of the variable resistor coupled to the selected row based upon the display data corresponding to the selected row. The variable resistor controller adjusts the resistance of the variable resistor coupled to the selected row to be inversely proportional to the sum of the display data corresponding to the selected row.

29 Claims, 9 Drawing Sheets

U.S. PATENT DOCUMENTS

| | | | | |
|---|---|---|---|---|
| 6,522,317 | B1 | 2/2003 | Satou et al. | |
| 6,611,246 | B1 | 8/2003 | Ito et al. | |
| 7,034,782 | B2 * | 4/2006 | Miyakawa et al. | 345/76 |
| 2001/0028346 | A1 | 10/2001 | Kudo et al. | |
| 2001/0038385 | A1 | 11/2001 | Negoi et al. | |
| 2001/0050662 | A1 | 12/2001 | Kota et al. | |
| 2002/0149608 | A1 | 10/2002 | Bu et al. | |
| 2002/0158585 | A1 | 10/2002 | Sundahl | |
| 2003/0011298 | A1 | 1/2003 | Palanisamy | |

FOREIGN PATENT DOCUMENTS

| | | | | |
|---|---|---|---|---|
| JP | 02267589 | A | * | 11/1990 |
| JP | 2003005712 | A | * | 1/1991 |
| JP | 2000-172236 | A | | 6/2000 |
| JP | 2000-258751 | A | | 9/2000 |
| JP | 2003-005712 | A | | 1/2003 |
| JP | 2004-138976 | A | | 5/2004 |

* cited by examiner

REMOVING CROSSTALK IN AN ORGANIC LIGHT-EMITTING DIODE DISPLAY

TECHNICAL FIELD

The present invention relates to an organic light-emitting diode (OLED) display panel and, more specifically, to driving the OLED display panel without generating crosstalk.

BACKGROUND OF THE INVENTION

An OLED display panel is generally comprised of an array of organic light emitting diodes (OLEDs) that have carbon-based films or other organic material films between two charged electrodes, generally a metallic cathode and a transparent anode typically being glass. Generally, the organic material films are comprised of a hole-injection layer, a hole-transport layer, an emissive layer and an electron-transport layer. When voltage is applied to the OLED cell, the injected positive and negative charges recombine in the emissive layer and create electro-luminescent light. Unlike liquid crystal displays (LCDs) that require backlighting, OLED displays are self-emissive devices—they emit light rather than modulate transmitted or reflected light. Accordingly, OLEDs are brighter, thinner, faster and lighter than LCDs, and use less power, offer higher contrast and are cheaper to manufacture.

An OLED display panel is driven by a driver including a row driver and a column driver. A row driver typically selects a row of OLEDs in the display panel, and the column driver provides driving current to one or more of the OLEDs in the selected row to light the selected OLEDs according to the display data.

Conventional OLED display panels have the shortcoming that cross-talk is generated in the display panel. The problem of cross-talk in conventional OLED display panels will be explained in greater detail below with reference to FIG. 1.

FIG. 1 illustrates a conventional OLED display panel driven by a conventional driver. The OLED display panel 100 comprises an array of OLEDs 102 coupled between the rows and columns of the display panel 100. The anodes of the OLEDs 102 are coupled to the columns and the cathodes of the OLEDs 102 are coupled to the rows of the display panel 100. The OLED display panel 100 is driven by driver including a row driver 120 and a column driver 140.

The row driver 120 includes row driver control circuitry (not shown) configured to couple the cathodes of the OLEDs associated with a row ( . . . ROW(n−1), ROW(n), ROW(n+1), ROW(n+2) . . . ) of the display panel 100 to either a low voltage (e.g., GND) via resistors ( . . . RL(n−1), RL(n), RL(n+1), RL(n) . . . ) by closing the switches 126 and opening the switches 124 to select the row or to a high voltage (e.g., VCC) by closing the switches 124 and opening the switches 126 to unselect the row. For example, in FIG. 1, ROW(n) is shown selected with the switch 126 associated with ROW(n) being closed to couple ROW(n) to GND. The selection of ROW(n) by the row driver 120 forward-biases the OLEDs 102 coupled to ROW(n).

The column driver 140 includes current sources 142 that provide current ( . . . I(n−1), I(n), I(n+1), and I(n+2) . . . ) to the columns (C(n−1), C(n), C(n+1), C(n+2) . . . ) of the panel 100 to drive OLEDs on the columns. Once a row is selected by the row driver 120, the current sources 142 of the column driver 140 generate current ( . . . I(n−1), I(n), I(n+1), and I(n+2) . . . ) for the corresponding columns (C(n−1), C(n), C(n+1), C(n+2) . . . ) according to the corresponding display data ( . . . Idata(n−1), Idata(n), Idata(n+1), Idata(n+2) . . . ) to drives the OLEDs 102 on the selected row. The amount of current ( . . . I(n−1), I(n), I(n+1), and I(n+2) . . . ) is typically generated to be multiples of a unit driving current (e.g., Iw) and proportional to the display data ( . . . Idata(n−1), Idata(n), Idata(n+1), Idata(n+2) . . . ).

In one embodiment, the display data may be 1-bit data indicating 2 levels of brightness, for example, bright ("1") or dark ("0"), of the OLEDs 102. Thus, the current ( . . . I(n−1), I(n), I(n+1), I(n+2) . . . ) from the current sources 142 is generated to be, for example, 0 or Iw. In another embodiment, the display data may be 2-bit data indicating 4 levels of brightness, for example, very dark ("0"), dark ("1"), bright ("2), and very bright ("3"), of the OLEDs 102. Thus, the current ( . . . I(n−1), I(n), I(n+1), I(n+2) . . . ) from the current sources 142 is generated to be, for example, 0 or Iw, 2×Iw, or 3×Iw. The OLEDs 102 in the selected row (e.g., ROW(n)) are lit (Iw, 2×Iw, or 3×Iw) or unlit (zero current) based upon the current ( . . . I(n−1), I(n), I(n+1), and I(n+2) . . . ) corresponding to the columns (C(n−1), C(n), C(n+1), C(n+2) . . . ) of the panel 100.

As can be seen from FIG. 1, the sink current (Isink(n)) of a selected row (ROW(n)) is determined by the sum of the current ( . . . I(n−1), I(n), I(n+1), I(n+2) . . . ) driving the columns (C(n−1), C(n), C(n+1), C(n+2) . . . ) of the selected row (ROW(n)), which in turn is determined by the display data ( . . . Idata(n−1), Idata(n), Idata(n+1), Idata(n+2) . . . ). Therefore, the sink voltage Vsink(n) across RL(n) coupled to the selected row ROW(n) is also determined by the display data ( . . . Idata(n−1), Idata(n), Idata(n+1), Idata(n+2) . . . ), since Vsink(n)=Isink(n)×RL(n). This means that the sink voltage Vsink(n) for the rows of the panel 100 are different from each other, since the column display data varies from row to row. This will be explained in greater detail with reference to FIG. 2.

FIG. 2 is illustrates a sample image for display to a conventional OLED display panel 100 by the display data. As shown in FIG. 2, each of the columns 1-100 is driven by a unit current source Iw. The display data is configured to make the region 202 of the panel 100 "black" while making the remaining areas 204 "white." Assuming a 2-bit display data (0 or 1), the current Iw will flow through the OLEDs coupled between row E and every column (0-100) to light the OLEDs on row E, making the-total sink current Isink(E) for row E as large as 100×Iw. In contrast, the current Iw will flow through the OLEDs coupled between row F and the columns 1-30 and columns 61-100 to light the OLEDs but not between row F and columns 31-60 on row F, making the total sink current Isink(F) for row F merely 70×Iw. Therefore, the sink voltages Vsink(E) and Vsink(F) on the resistors RL(E) and RL(F) coupled to rows E and F, respectively, will be: Vsink(E)=(Iw·100)·RL(E), and Vsink(F)=(Iw·70)·RL(F). Since RL(E) is equal to RL(F) in conventional row drivers, Vsink(E) becomes larger than Vsink(F), resulting in a forward-bias voltage for the OLEDs on Row F greater than the forward-bias voltage for the OLEDs on Row E.

FIG. 3 is a graph illustrating the driving voltage versus brightness characteristics of OLED pixels on a conventional OLED display panel 100. Line 302 illustrates the driving voltage versus brightness characteristics of the OLEDs on row E and line 304 illustrates the driving voltage versus brightness characteristics of the OLEDs on Row(F). As shown in FIG. 3, the OLEDs on Row F are brighter than the OLEDs on Row(E) for a given column driving voltage, because the cathodes of the OLEDs on Row(F) are biased with a voltage lower than-the voltage biasing the cathodes of the OLEDs on Row(E), i.e., the forward-bias voltage for the OLEDs on Row(F) is greater than the forward-bias voltage for the OLEDs on Row(E).

FIG. 4 illustrates a sample image that would be actually displayed on a conventional OLED display panel 100 by the display data due to differing forward-bias voltages for the OLEDs from row to row as illustrated in FIG. 3. Because the OLEDs on Row(F) are brighter than the OLEDs on Row(E), the regions 302 on Row(F) would display a "white" brighter than the "white" in regions 204 on Row (E). The difference in the brightness in these "white" regions 204, 304 is generally referred to as "crosstalk."

Therefore, there is a need for a driver that can drive an OLED display panel without generating crosstalk.

SUMMARY OF THE INVENTION

The present invention provides a driver for driving an OLED display panel including a plurality of organic light emitting diodes (OLEDs) arranged in rows and columns without generating crosstalk in the display panel. The driver is configured to select an active row and to provide current driving the OLEDs coupled between the columns and the active row in accordance with display data corresponding to the columns and the selected row. The driver includes a plurality of variable resistors each of which is coupled to a corresponding one of the rows, in general between Ground (GND) and the cathodes of the OLEDs on the row. A variable resistor controller in the driver is coupled to the variable resistors, and adjusts the resistance of the variable resistor coupled to the selected row based upon the display data corresponding to the columns and the selected row.

In one embodiment, the variable resistor controller adjusts the resistance of the variable resistor coupled to the selected row based upon a sum of the display data corresponding to the columns and the selected row. In another embodiment, the variable resistor controller adjusts the resistance of the variable resistor coupled to the selected rows to be inversely proportional to the sum of the display data corresponding to the columns and the selected row. In still another embodiment, the variable resistor controller adjusts the resistance of the variable resistor coupled to the selected row in accordance with:

$$RL(n) = RL(\min) \cdot \frac{\mathrm{Max}SumDisplayData}{SumDisplayData},$$

where RL(min) is a predetermined minimum resistance, SumDisplayData is the sum of the display data corresponding to the columns and the selected row, and MaxSumDisplayData is the maximum possible sum of the display data.

The OLED display driver according to the present invention has the advantage that the voltage drop across the variable resistors is uniform from row to row regardless of the amount of sink current on the rows, because the resistances of the variable resistors are adjusted based upon the display data for the rows. This is because the display-data for the rows are proportional to the expected sink current for the rows. Therefore, the bias voltage on the cathodes of the OLEDs is same from row to row, and thus the OLEDs display the same brightness from row to row. Accordingly, the OLED display panels driven by the driver of the present invention does not generate crosstalk.

BRIEF DESCRIPTION OF THE DRAWINGS

The teachings of the present invention can be readily understood by considering the following detailed description in conjunction with the accompanying drawings. Like reference numerals are used for like elements in the accompanying drawings.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF EMBODIMENTS

Figure 5:
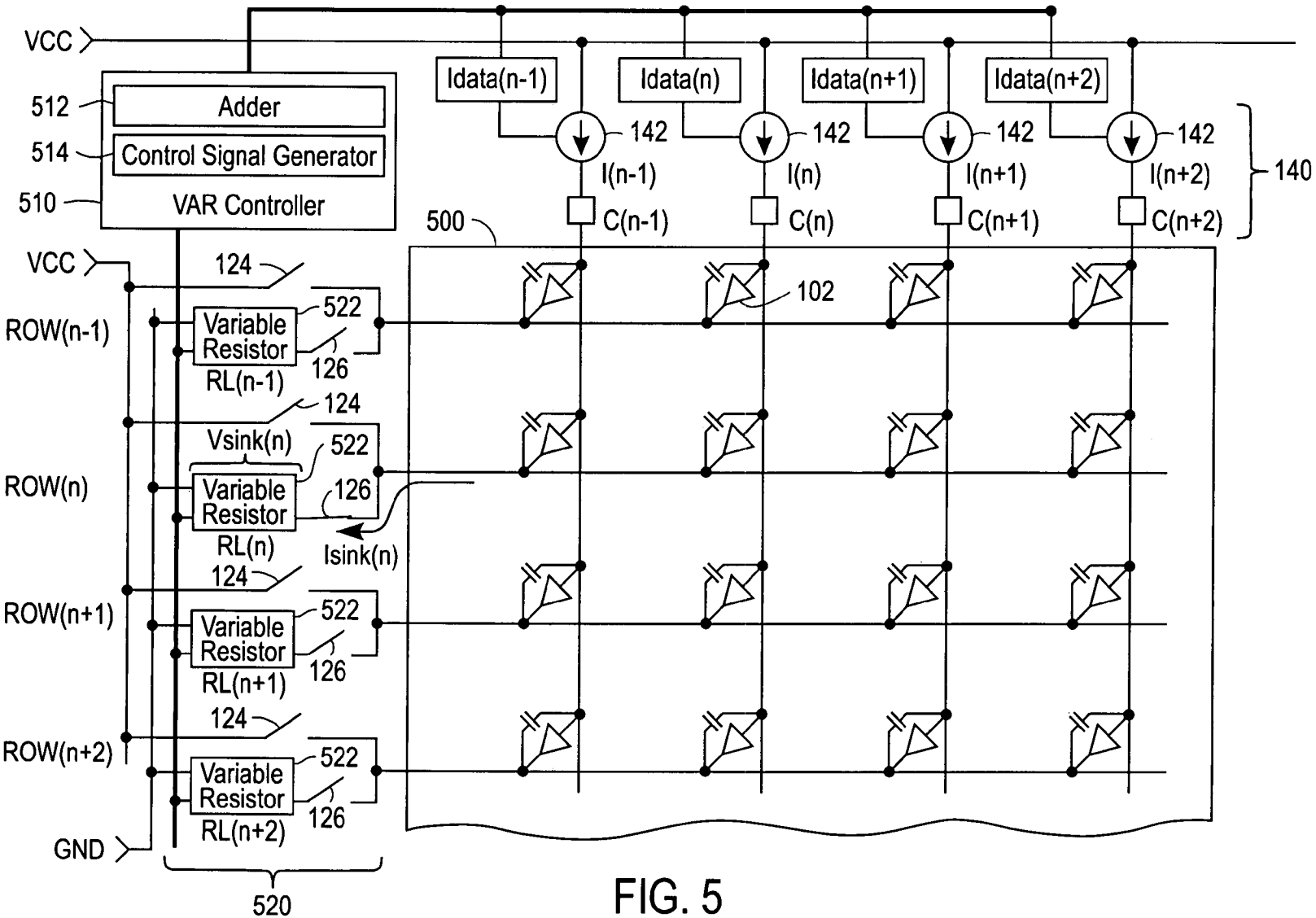
FIG. 5 illustrates an OLED display panel driven by a driver according to one embodiment of the present invention.

FIG. 5 illustrates an OLED display panel driven by a driver according to one embodiment of the present invention. The OLED display panel 500 comprises an array of OLEDs 102 coupled between the rows and columns of the panel 500. The anodes of the OLEDs 102 are coupled to the columns ( . . . C(n−1), C(n), C(n+1), C(n+2), . . . ) and the cathodes of the OLEDs 102 are coupled to the rows ( . . . ROW(n−1), ROW(n), ROW(n+1), and ROW(n+2) . . . ) of the display panel 500. The OLED display panel 500 is driven by the driver including a row driver 520 and a column driver 140.

Figure 1:
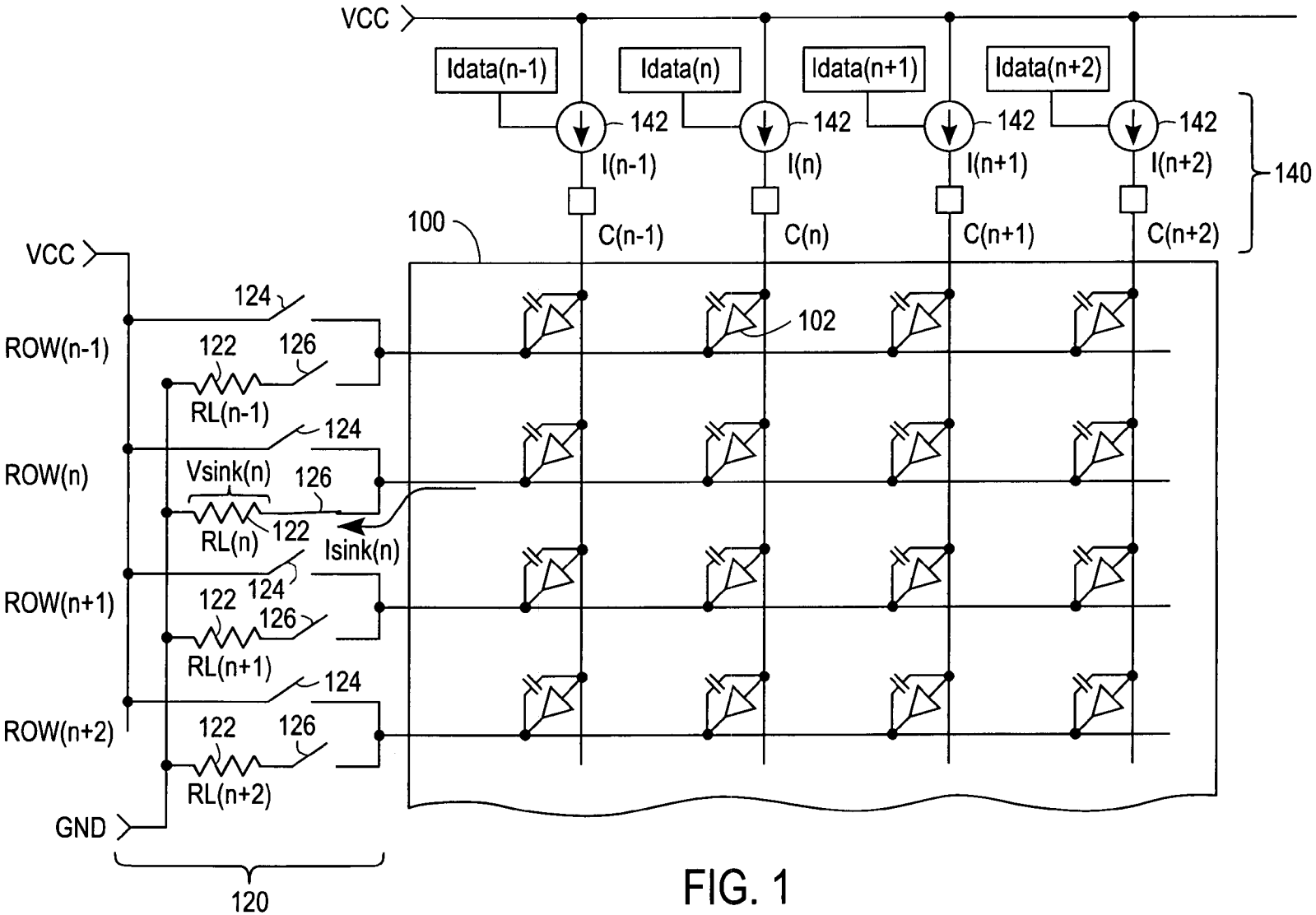
FIG. 1 illustrates a conventional OLED display panel driven by a conventional driver.
Figure 2:
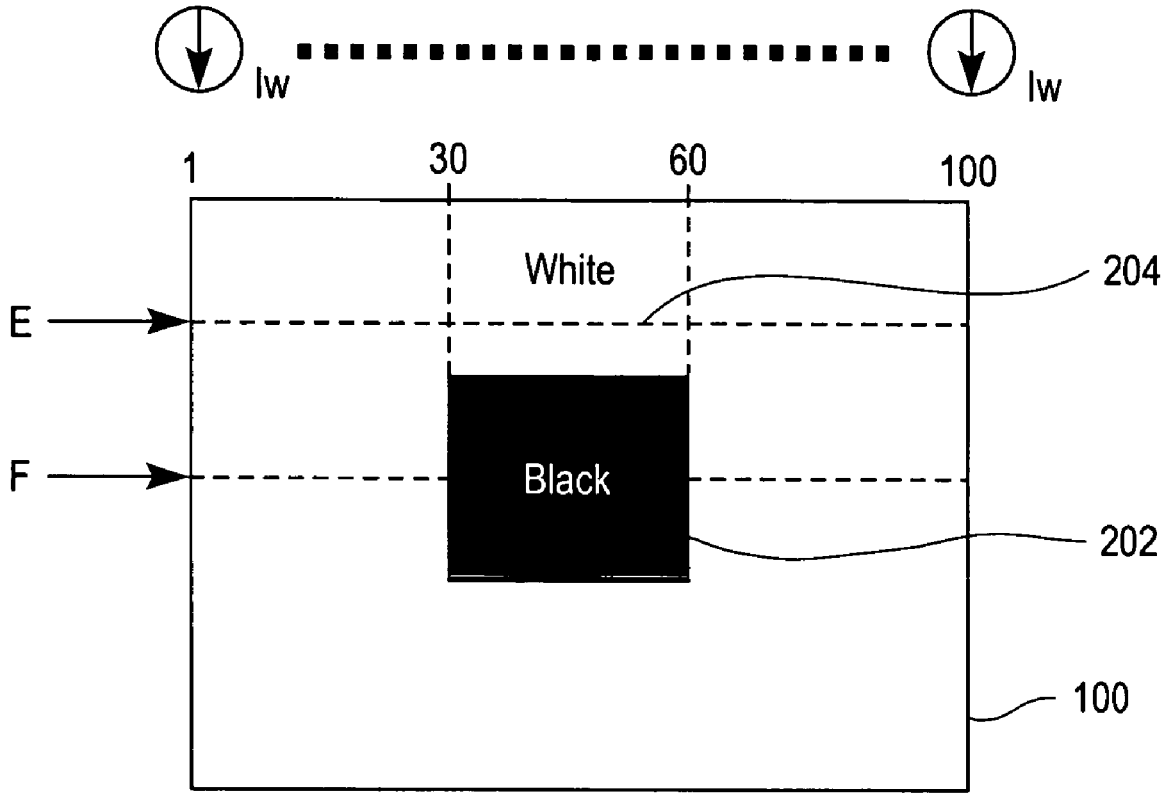
FIG. 2 is illustrates a sample image for display to a conventional OLED display panel by the display data.
Figure 3:
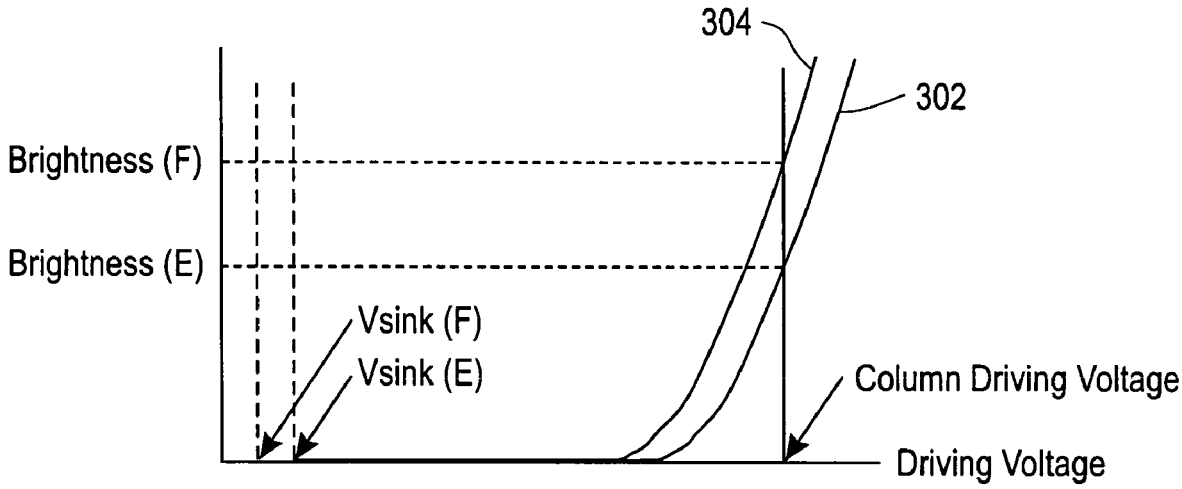
FIG. 3 is a graph illustrating the driving voltage versus brightness characteristics of OLED pixels on a conventional OLED display panel.
Figure 4:
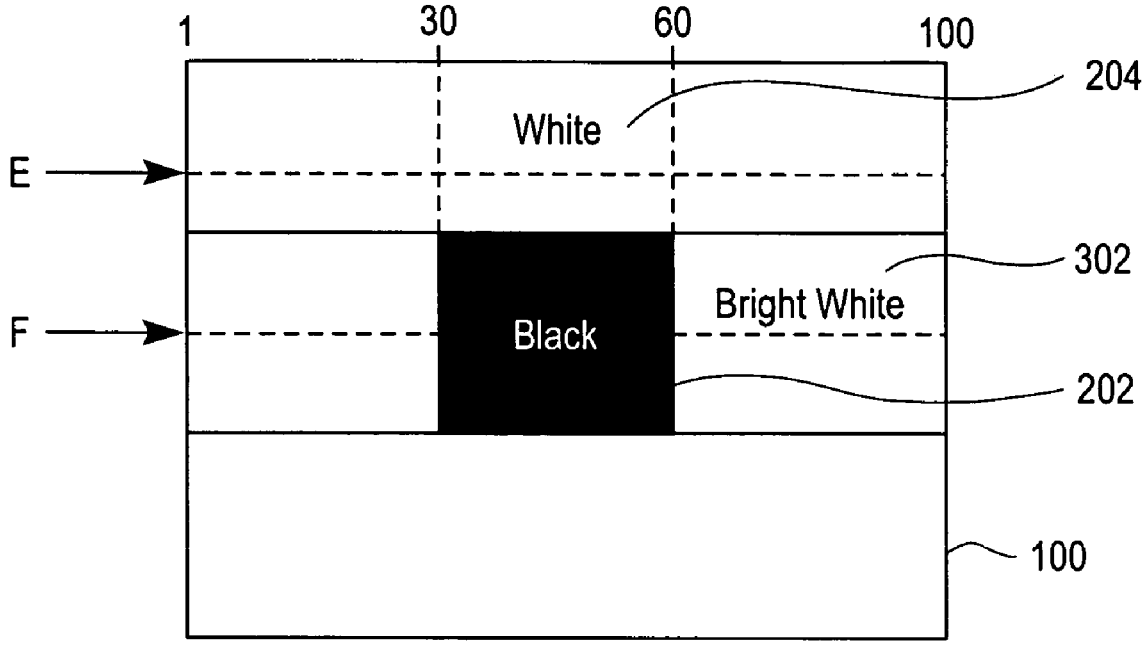
FIG. 4 illustrates a sample image that would be actually displayed on a conventional OLED display panel 100 by the display data due to differing forward-bias voltages for the OLEDs from row to row as illustrated in FIG. 3.

The row driver 520 includes row driver control circuitry (not shown) configured to couple the cathodes of the OLEDs 102 associated with a row ( . . . ROW(n−1), ROW(n), ROW(n+1), ROW(n+2) . . . ) of the panel 500 to either a low voltage (e.g., GND) via variable resistors 522 having variable resistance values ( . . . RL(n−1), RL(n), RL(n+1), RL(n) . . . ) by closing the switches 126 and opening the switch 124 to select the row or to a high voltage (e.g., VCC) by closing the switches 124 and opening the switches 126 to unselect the row. For example, in FIG. 1, ROW(n) is shown selected with the switch 126 associated with ROW(n) being closed to couple ROW(n) to GND via one of the variable resistors 522 having a resistance value RL(n). The selection of ROW(n) by the row driver 520 forward-biases the OLEDs 102 coupled, to ROW(n).

The column driver 140 includes current sources 142 that provide current ( . . . I(n−1), I(n), I(n+1), and I(n+2) . . . ) to the columns ( . . . C(n−1), C(n), C(n+1), C(n+2) . . . ) of the display panel 500 to drive the columns ( . . . C(n−1), C(n), C(n+1), C(n+2) . . . ). Once a row is selected by the row driver 520, the current sources 142 of the column driver 140 generate current ( . . . I(n−1), I(n), I(n+1), and I(n+2) . . . ) for the corresponding columns (C(n−1), C(n), C(n+1), C(n+2) . . . ) according to the corresponding display data ( . . . Idata(n−1), Idata(n), Idata(n+1), Idata(n+2) . . . ) to drives the OLEDs 102 on the selected row. The amount of current ( . . . I(n−1), I(n), I(n+1), and I(n+2) . . . ) is generated to be multiples of a unit driving current (e.g., Iw) and proportional to the display data ( . . . Idata(n−1), Idata(n), Idata(n+1), Idata(n+2) . . . ).

In one embodiment, the display data ( . . . Idata(n−1), Idata(n), Idata(n+1), Idata(n+2) . . . ) may be 1-bit data indicating 2 levels of brightness, for example, bright ("1") or dark ("0"), of the OLEDs 102. Thus, the current from the current source is generated to be, for example, 0 or Iw. In another embodiment, the display data ( . . . Idata(n−1), Idata(n), Idata(n+1), Idata(n+2) . . . ) may be 2-bit data indicating 4 levels of brightness, for example, very dark ("0"), dark ("1"), bright ("2), and very bright ("3"), of the OLEDs 102. Thus, the current from the current source 142 is generated to be, for example, 0 or Iw, 2×Iw, or 3×Iw). The OLEDs 102 in the selected row (e.g., ROW(n)) are lit (1w, 2×Iw, or 3×Iw) or unlit (for zero current) based upon the driving current ( . . . I(n−1), I(n), I(n+1), and I(n+2) . . . ) corresponding to the columns ( . . . C(n−1), C(n), C(n+1), C(n+2) . . . ), respectively, of the display panel 500. It should be noted that the display data may have any number of bits representing a different variety of brightness levels and that the present invention is not limited to the display data described herein.

The sink current (Isink(n)) of a selected row (ROW(n)) is determined by the sum of the current ( . . . I(n−1), I(n), I(n+1), I(n+2) . . . ) driving the columns (C(n−1), C(n), C(n+1), C(n+2) . . . ) of the selected row (ROW(n)), which in turn is determined by the display data ( . . . Idata(n−1), Idata(n), Idata(n+1), Idata(n+2) . . . ). Therefore, the sink voltage Vsink(n) across RL(n) is also determined by the display data ( . . . Idata(n−1), Idata(n), Idata(n+1), Idata(n+2) . . . ), since Vsink(n)=Isink(n)×RL(n).

The VAR (Variable Resistor) controller 510 is coupled to receive the display data ( . . . Idata(n−1), Idata(n), Idata(n+1), Idata(n+2) . . . ) for the selected row (e.g., ROW(n)) and controls the resistance value of the variable resistor 522 (e.g., RL(n)) of the selected row (ROW(n)) based upon the display data. Specifically, the VAR controller 510 includes an adder 512 for summing the display data ( . . . Idata(n−1), Idata(n), Idata(n+1), Idata(n+2) . . . ) for the selected row (e.g., ROW(n)), and a control signal generator 514 that generates control signals for adjusting the resistance value of the variable resistor 522 of the selected row (e.g., ROW(n)) based upon the value of the sum of the display data.

The VAR controller 510 adjusts the resistance value of the variable resistor 522 coupled to the selected row (ROW(n)) to be inversely proportional to the sum of the display data for the selected row (ROW(n)), so that the resistance of the variable resistor 522 coupled to the selected row (ROW(n)) becomes lower if the sink current Isink(n) that would be generated by the display data for the selected row (ROW(n)) becomes greater, and vice versa. In one embodiment, the VAR controller 510 adjusts the resistance (RL(n)) of the variable resistor 522 coupled to the selected row (ROW(n)) to be:

$$RL(n) = RL(\min) \cdot \frac{\mathrm{Max}SumDisplayData}{SumDisplayData},$$

where RL(min) is a predetermined minimum resistance, SumDisplayData is the sum of the display data corresponding to the columns of the selected row (ROW(n)), MaxSumDisplayData is the maximum possible sum of the display data occurring when all columns of the selected row (ROW(n)) are lit at its maximum brightness. For example, MaxSumDisplayData may be 100 for 1 bit display data ("0" or "1") driving 100 columns, or 300 for 2 bit display data ("0," "1," "2," or "3,") driving 100 columns. SumDisplayData and MaxSumDisplayData may also be represented in binary data. The adjustment of the resistance values of the variable resistors 522 is explained in greater detail below with reference to FIG. 6.

Figure 6:
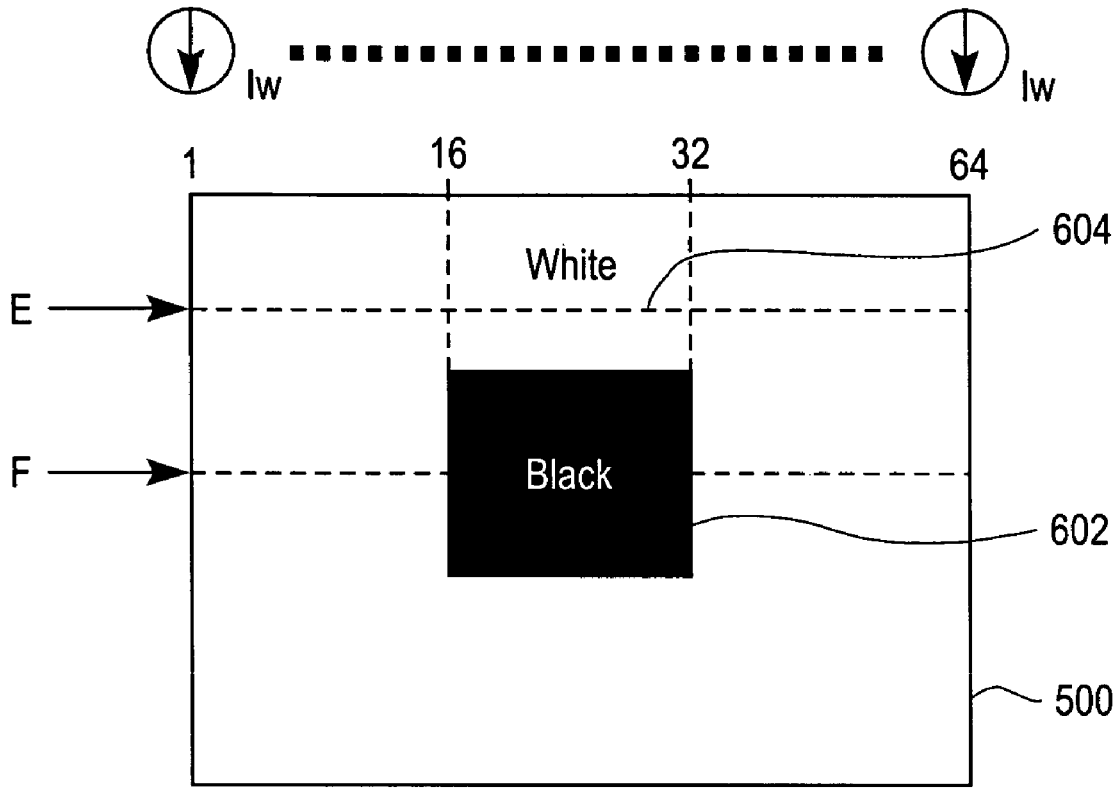
FIG. 6 is illustrates a sample image for display to an OLED display panel by the display data, according to one embodiment of the present invention.

FIG. 6 is illustrates a sample image for display to an OLED display panel 500 by the display data, according to one embodiment of the present invention. As shown in FIG. 6, each of the columns 1-64 is driven by a unit current source Iw. The display data is configured to make the region 602 of the panel 100 "black" while making the remaining areas 604 "white." Assuming a 2-bit display data (0 or 1), the current Iw will flow through every column (1-64) in row E to light the OLEDs on row E, making the total sink current Isink(E) for row E as large as 64×Iw. In contrast, the current Iw will flow through columns 1-16 and 33-64 to light the OLEDs but not through columns 17-32 on row F, making the total sink current Isink(F) for row F 48×Iw.

Assuming 2-bit display data, the sum of the display data, $SumDisplayData_E$, for row E will be 64 while the sum of the display data, $SumDisplayData_F$, for row F will be 48. The maximum possible sum of the display data, MaxSumDisplayData, is also 64. In one embodiment, SumDisplayData and MaxSumDisplayData may be indicated in binary form, for example, in 7 bit binary data, although the particular manner in which SumDisplayData and MaxSumDisplayData are indicated is not a requirement of the present invention.

According to one embodiment of the present invention, the resistance RL(E) of the variable resistor 522 for Row E is adjusted to be:

$$\begin{aligned} RL(E) &= RL(\min) \cdot \frac{\mathrm{Max}SumDisplayData}{SumDisplayData_E} \\ &= RL(\min) \cdot \frac{64}{64} = RL(\min), \end{aligned}$$

while the resistance RL(F) of the variable resistor 522 for Row F is adjusted to be:

$$\begin{aligned} RL(F) &= RL(\min) \cdot \frac{\mathrm{Max}SumDisplayData}{SumDisplayData_F} \\ &= RL(\min) \cdot \frac{64}{48}. \end{aligned}$$

Thus, the sink voltage Vsink(E) and Vsink(F) for rows E and F, respectively, will be:

$$Vsink(E)=Isink(E)\cdot RL(E)=64\cdot Iw\cdot RL(\min),$$

$$Vsink(F)=Isink(F)\cdot RL(F)=48\cdot Iw\cdot RL(\min)\cdot 64/48=64\cdot Iw\cdot RL(\min).$$

In other words, Vsink(E) is equal to Vsink(F) according to the present invention, and thus the brightness of the "white" regions of the display panel 500 is uniform throughout rows E and F.

Figure 7:
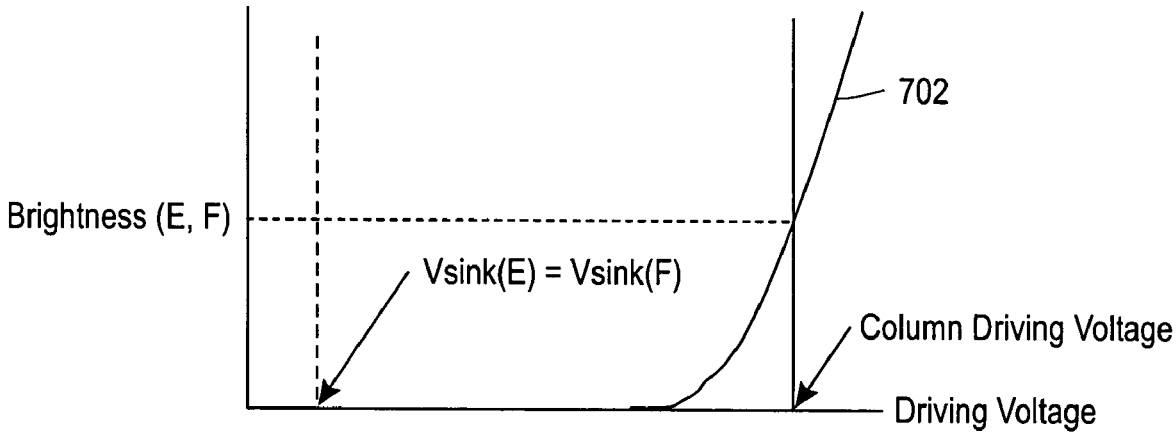
FIG. 7 is a graph illustrating the driving voltage versus brightness characteristics of OLED pixels on an OLED display panel according to the present invention.

FIG. 7 is a graph illustrating the driving voltage versus brightness characteristics of OLED pixels of the display panel 500 according to the present invention. The driving voltage versus brightness characteristics 702 are identical for the OLEDs on both rows, ROW(E) and ROW(F) (FIG. 6), for a given column driving voltage, since the sink voltages Vsink(E) and Vsink(F) are identical as explained with reference to FIG. 6. Thus, the OLEDs on both rows, ROW(E) and ROW(F), will have the same brightness.

Figure 8:
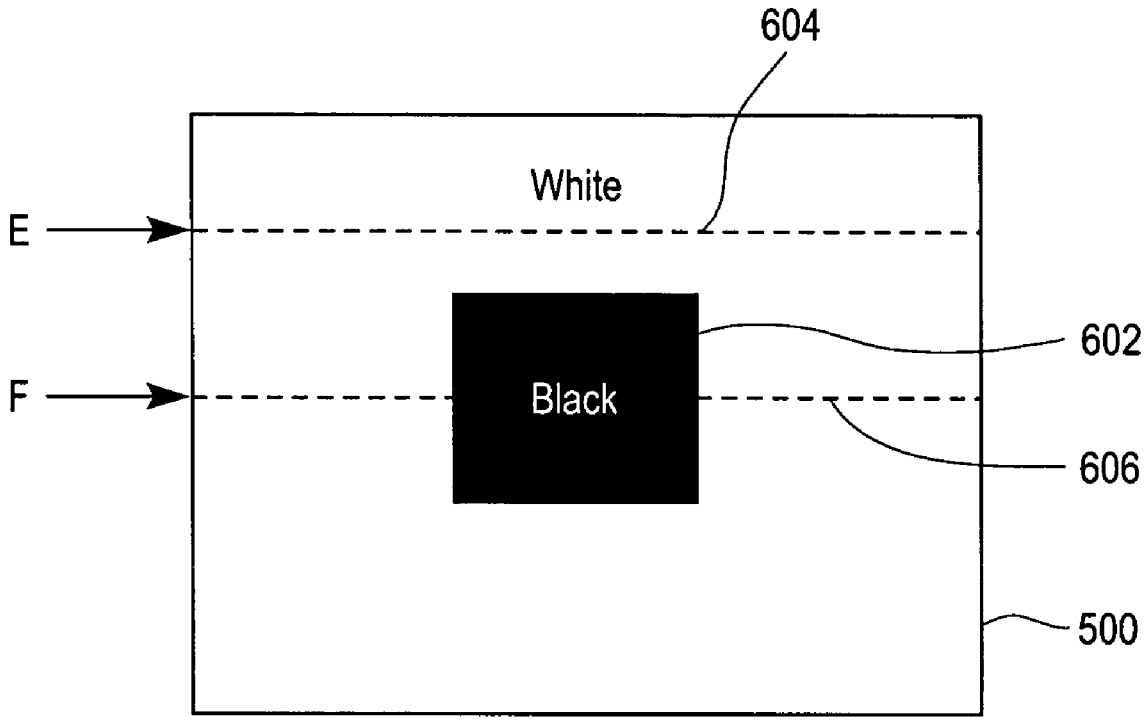
FIG. 8 illustrates a sample image that would be actually displayed on an OLED display panel by the display data, according to one embodiment of the present invention.

FIG. 8 illustrates a sample image that would be actually displayed on an OLED display panel 500 by the display data, according to one embodiment of the present invention. Because the brightness of the OLEDs on rows Row(E) and Row(F) are the same, the "white" regions 606 on Row(F) would display "white" having the same brightness as the "white" displayed in regions 604 on Row(E). Thus, the OLED display panel 500 according to the present invention does not have crosstalk.

Figure 9:
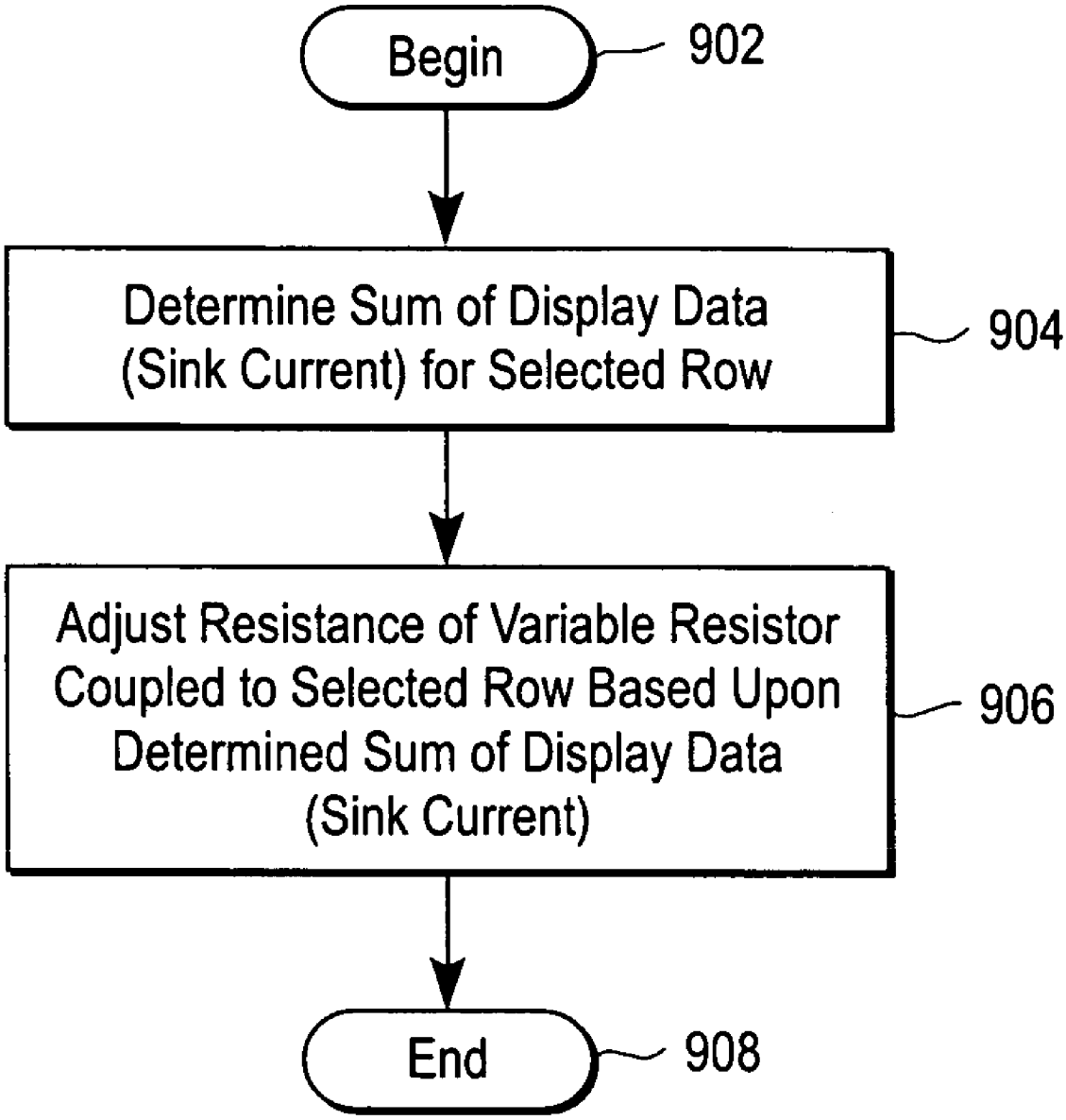
FIG. 9 is a flowchart illustrating a method of adjusting the resistance of the variable resistors coupled to the rows of the OLED panel according to one embodiment of the present invention.

FIG. 9 is a flowchart illustrating a method of adjusting the resistance of the variable resistors coupled to the rows of the OLED panel according to one embodiment of the present invention. As the process begins 902, the driver for the OLED display panel determines 904 the sum of the display data (SumDisplayData) for the selected row (ROW(n)). This sum will be proportional to the sink current Isink(n) for the selected row (ROW(n)).

Then, the driver adjusts 906 the resistance RL(n) of the variable resistor 522 coupled to the selected row (ROW(n)). In one embodiment, the resistance RL(n) is adjusted to be inversely proportional to SumDisplayData. In another embodiment, the resistance (RL(n)) of the variable resistor 522 of a selected row (ROW(n)) is adjusted to be:

$$RL(n) = RL(\min)\cdot\frac{\mathrm{Max}SumDisplayData}{SumDisplayData},$$

where RL(min) is a predetermined minimum resistance, SumDisplayData is the sum of the display data for the columns of the selected row (ROW(n)), and MaxSumDisplayData is the maximum possible sum of the display data occurring when all columns of the selected row (ROW(n)) are lit to be at its maximum brightness. Then, the process ends 908.

The present invention has the advantage that the voltage drops across the variable resistors 522 are uniform from row to row regardless of the amount of sink current Isink(n) on the rows, because the resistance values of the variable resistors 522 are adjusted based upon the display data corresponding to the rows, which is also proportional to the expected sink current Isink(n) for the rows. Therefore, the bias voltage on the cathodes of the OLEDs is same from row to row, and thus the OLEDs display the same brightness from row to row. Accordingly, the OLED display panels driven by the driver in accordance with the present invention does not show crosstalk.

Although the present invention has been described above with respect to several embodiments, various modifications can be made within the scope of the present invention. For example, the resistances of the variable resistors may be adjusted not only based upon sum of the display data (which is a digital value) but also based upon the sum of the driving current (which is an analog value) driving the OLEDs coupled between the columns and the selected row. In such case, the driver may further include analog-to-digital converters for converting the driving current to digital values that can be used to control the variable resistors. In addition, the present invention is not limited to any particular-format or number of bits for representing the sum of the display data. Nor is the present invention limited to any particular number of bits used for the display data (e.g., 1 bit or 2 bit display data).

Accordingly, the disclosure of the present invention is intended to be illustrative, but not limiting, of the scope of the invention, which is set forth in the following claims.

What is claimed is:

1. A driver for driving an organic light-emitting diode (OLED) display panel including a plurality of organic light emitting diodes (OLEDs) arranged in rows and columns, the driver configured to select one of the rows and to provide current driving the OLEDs coupled between the columns and said selected one of the rows in accordance with display data corresponding to said selected one of the rows, the driver comprising:

a plurality of variable resistors, each of the variable resistors coupled to a corresponding one of the rows; and a variable resistor controller coupled to the variable resistors, the variable resistor controller adjusting a resistance of the variable resistor coupled to said selected one of the rows to be inversely proportional to a sum of the display data corresponding to said selected one of the rows.

2. The driver of claim 1, wherein the variable resistor controller adjusts the resistance of the variable resistor coupled to said selected one of the rows in accordance with:

$$RL(n) = RL(\min)\cdot\frac{\mathrm{Max}SumDisplayData}{SumDisplayData},$$

where RL(min) is a predetermined minimum resistance value, SumDisplayData is the sum of the display data corresponding to said selected one of the rows, and MaxSumDisplayData is a maximum possible sum of the display data.

3. The driver of claim 1, wherein the variable resistor controller comprises an adder for adding the display data corresponding to said selected one of the rows to generate the sum of the display data.

4. The driver of claim 1, wherein the display data are 1-bit data indicating 2 levels of brightness.

5. The driver of claim 1, wherein the display data are 2-bit data indicating 4 levels of brightness.

6. The driver of claim 1, wherein each of the variable resistors is coupled between Ground (GND) and cathodes of the OLEDs on said corresponding one of the rows.

7. The driver of claim 1, wherein each of the variable resistors is decoupled from said corresponding one of the rows if said corresponding one of the rows is not selected by the driver.

8. A driver for driving an organic light-emitting diode (OLED) display panel including a plurality of organic light emitting diodes (OLEDs) arranged in rows and columns, the driver configured to select one of the rows and to provide current driving the OLEDs coupled between the columns and said selected one of the rows, the driver comprising:

a plurality of variable resistors, each of the variable resistors coupled to a corresponding one of the rows; and a variable resistor controller coupled to the variable resistors, the variable resistor controller adjusting a resistance of the variable resistor coupled to said selected one of the rows to be inversely proportional to a sum of the current driving the OLEDs coupled between the columns and said selected one of the rows.

9. In a driver for driving an organic light-emitting diode (OLED) display panel including a plurality of organic light emitting diodes (OLED) arranged in rows and columns, the driver configured to select one of the rows and to provide current driving the OLEDs coupled between the columns and said selected one of the rows in accordance with display data corresponding to said selected one of the rows, a method comprising:

determining a sum of the display data corresponding to said selected one of the rows; and adjusting a resistance of a variable resistor coupled to said selected one of the rows to be inversely proportional to the sum of the display data corresponding to said selected one of the rows.

10. The method of claim 9, wherein adjusting a resistance of a variable resistor comprises adjusting the resistance of the variable resistor coupled to said selected one of the rows in accordance with:

$$RL(n) = RL(\min) \cdot \frac{\mathrm{Max}SumDisplayData}{SumDisplayData},$$

where RL(min) is a predetermined minimum resistance value, SumDisplayData is the sum of the display data corresponding to said selected one of the rows, and MaxSumDisplayData is a maximum possible sum of the display data.

11. The method of claim 9, wherein the display data are 1-bit data indicating 2 levels of brightness.

12. The method of claim 9, wherein the display data are 2-bit data indicating 4 levels of brightness.

13. In a driver for driving an organic light-emitting diode (OLED) display panel including a plurality of organic light emitting diodes (OLEDs) arranged in rows and columns, the driver configured to select one of the rows and to provide current driving the OLEDs coupled between the columns and said selected one of the rows, a method comprising:

determining a sum of the current driving the OLEDs coupled between the columns and said selected one of the rows; and adjusting a resistance of a variable resistor coupled to said selected one of the rows to be inversely proportional to the sum of the current.

14. A driver for driving an organic light-emitting diode (OLED) display panel including a plurality of organic light emitting diodes (OLEDs) arranged in rows and columns, the driver configured to select one of the rows and to provide current driving the OLEDs coupled between the columns and said selected one of the rows in accordance with display data corresponding to said selected one of the rows, the driver comprising:

a plurality of variable resistor means for providing variable resistance to a corresponding one of the rows; and controller means coupled to the plurality of variable resistor means, the controller means adjusting a resistance of the variable resistor means coupled to said selected one of the rows to be inversely proportional to a sum of the display data corresponding to said selected one of the rows.

15. The driver of claim 14, wherein the controller means adjusts the resistance of the variable resistor means coupled to said selected one of the rows in accordance with:

$$RL(n) = RL(\min) \cdot \frac{\mathrm{Max}SumDisplayData}{SumDisplayData},$$

where RL(min) is a predetermined minimum resistance value, SumDisplayData is the sum of the display data corresponding to said selected one of the rows, and MaxSumDisplayData is a maximum possible sum of the display data.

16. A driver for driving an organic light-emitting diode (OLED) display panel including a plurality of organic light emitting diodes (OLEDs) arranged in rows and columns, the driver configured to select one of the rows and to provide current driving the OLEDs coupled between the columns and said selected one of the rows, the driver comprising:

a plurality of variable resistor means, each of the variable resistor means coupled to a corresponding one of the rows; and controller means coupled to the plurality of variable resistor means, the controller means adjusting a resistance of the variable resistor means coupled to said selected one of the rows to be inversely proportional to a sum of the current driving the OLEDs coupled between the columns and said selected one of the rows.

17. An organic light-emitting diode (OLED) display device comprising:

an OLED display panel including a plurality of organic light emitting diodes (OLEDs) arranged in rows and columns; and a driver configured to select one of the rows and to provide current driving the OLEDs coupled between the columns and said selected one of the rows in accordance with display data corresponding to said selected one of the rows, the driver comprising:

a plurality of variable resistors, each of the variable resistors coupled to a corresponding one of the rows; and a variable resistor controller coupled to the variable resistors, the variable resistor controller adjusting a resistance of the variable resistor coupled to said selected one of the rows to be inversely proportional to a sum of the display data corresponding to said selected one of the rows.

18. The organic light-emitting diode display device of claim 17, wherein the variable resistor controller adjusts the resistance of the variable resistor coupled to said selected one of the rows in accordance with:

$$RL(n) = RL(\min) \cdot \frac{\mathrm{Max}SumDisplayData}{SumDisplayData},$$

where RL(min) is a predetermined minimum resistance value, SumDisplayData is the sum of the display data corresponding to said selected one of the rows, and MaxSumDisplayData is a maximum possible sum of the display data.

19. The organic light-emitting diode display device of claim 17 wherein the variable resistor controller includes an adder for adding the display data corresponding to said selected one of the rows to generate the sum of the display data.

20. The organic light-emitting diode display device of claim 17, wherein the display data are 1-bit data indicating 2 levels of brightness.

21. The organic light-emitting diode display device of claim 17, wherein the display data are 2-bit data indicating 4 levels of brightness.

22. The organic light-emitting diode display device of claim 17, wherein each of the variable resistors is coupled between Ground (GND) and cathodes of the OLEDs on said corresponding one of the rows.

23. The organic light-emitting diode display device of claim 17, wherein each of the variable resistors is decoupled from said corresponding one of the rows if said corresponding one of the rows is not selected by the driver.

24. An organic light-emitting diode (OLED) display device comprising:

an organic light-emitting diode display panel including a plurality of organic light emitting diodes (OLEDs) arranged in rows and columns; and a driver configured to select one of the rows and to provide current driving the OLEDs coupled between the columns and said selected one of the rows, the driver comprising:

a plurality of variable resistors, each of the variable resistors coupled to a corresponding one of the rows; and a variable resistor controller coupled to the variable resistors, the variable resistor controller adjusting a resistance of the variable resistor coupled to said selected one of the rows to be inversely proportional to a sum of the current driving the OLEDs coupled between the columns and said selected one of the rows.

25. In an organic light-emitting diode (OLED) display device including an organic light-emitting diode display panel having a plurality of organic light emitting diodes (OLEDs) arranged in rows and columns and a driver configured to select one of the rows and to provide current driving the OLEDs coupled between the columns and said selected one of the rows in accordance with display data corresponding to said selected one of the rows, a method comprising:

determining a sum of the display data corresponding to the columns and said selected one of the rows; and adjusting a resistance of a variable resistor coupled to said selected one of the rows to be inversely proportional to a sum of the display data corresponding to said selected one of the rows.

26. The method of claim 25, wherein adjusting a resistance of a variable resistor comprises adjusting the resistance of the variable resistor coupled to said selected one of the rows in accordance with:

$$RL(n) = RL(\min) \cdot \frac{\mathrm{Max}SumDisplayData}{SumDisplayData},$$

where RL(min) is a predetermined minimum resistance value, SumDisplayData is the sum of the display data corresponding to said selected one of the rows, and MaxSumDisplayData is a maximum possible sum of the display data.

27. The method of claim 25, wherein the display data are 1-bit data indicating 2 levels of brightness.

28. The method of claim 25, wherein the display data are 2-bit data indicating 4 levels of brightness.

29. In an organic light-emitting diode (OLED) display device including an organic light-emitting diode display panel having a plurality of organic light emitting diodes (OLEDs) arranged in rows and columns and a driver configured to select one of the rows and to provide current driving the OLEDs coupled between the columns and said selected one of the rows, a method comprising:

determining a sum of the current driving the OLEDs coupled between the columns and said selected one of the rows; and adjusting a resistance of a variable resistor coupled to said selected one of the rows to be inversely proportional to the sum of the current.

* * * * *

UNITED STATES PATENT AND TRADEMARK OFFICE

CERTIFICATE OF CORRECTION

PATENT NO. : 7,298,351 B2
APPLICATION NO. : 10/884721
DATED : November 20, 2007
INVENTOR(S) : Chang Oon Kim It is certified that error appears in the above-identified patent and that said Letters Patent is hereby corrected as shown below:

On the title page, item [73] change the Assignee's name, Assignee from "Leadia Technology, Inc." to --Leadis Technology, Inc.--

Column 9, Line 22, change "(OLED)" to --(OLEDs)--

Signed and Sealed this

Eighth Day of April, 2008

JON W. DUDAS
*Director of the United States Patent and Trademark Office*